United States Patent [19]

Zuwala et al.

[11] Patent Number: 4,530,748

[45] Date of Patent: Jul. 23, 1985

[54] CELL CONFIGURATION FOR APPARATUS FOR ELECTROLYTIC RECOVERY OF SILVER FROM SPENT PHOTOGRAPHIC PROCESSING SOLUTIONS

[75] Inventors: Stanley M. Zuwala, Cambridge; Lloyd D. Cass, Toronto, both of Canada

[73] Assignee: New Horizons Manufacturing Ltd., Ontario, Canada

[21] Appl. No.: 611,112

[22] Filed: May 17, 1984

[51] Int. Cl.[3] ..... C25C 7/00

[52] U.S. Cl. ..... 204/273; 204/109

[58] Field of Search ..... 204/273, 109

[56] References Cited

U.S. PATENT DOCUMENTS

| | | | |
|---|---|---|---|
| 3,583,897 | 6/1971 | Fulweiler | 204/109 |
| 3,647,646 | 3/1972 | Tucker et al. | 204/273 |
| 3,702,814 | 11/1972 | Mandroian | 204/109 |
| 4,053,377 | 10/1977 | Schlain et al. | 204/106 |

*Primary Examiner*—R. L. Andrews

*Attorney, Agent, or Firm*—R. Craig Armstrong

[57] ABSTRACT

Novel apparatus of the rotating cathode type for the electrolytic recovery of silver from spent photographic processing solutions is disclosed. The apparatus comprises a tank, at least one cylindrical cathode carried for rotation in the tank about a vertical axis, and for each cathode, at least one vertically disposed slat-like anode positioned with respect to the cathode surface so as to define a vertically elongated venturi between the cathode and the anode, the narrowest section of each venturi being substantially along a vertical edge of each anode, and preferably being not substantially more than about one inch in dimension. Each anode preferably is substantially parallel to a tangent drawn to the cathode surface opposite the vertical edge of the anode at the narrowest section of the venturi. The vertical edge of each anode at the narrowest section of the venturi preferably has a ninety-degree or sharper corner, whereby the strength of the electric field is concentrated in the region of the venturi. The cross-sectional area of the cathode or cathodes is preferably at least ten percent of the cross-sectional area of the tank, for good mass transfer of solution in the apparatus.

16 Claims, 6 Drawing Figures

CELL CONFIGURATION FOR APPARATUS FOR ELECTROLYTIC RECOVERY OF SILVER FROM SPENT PHOTOGRAPHIC PROCESSING SOLUTIONS

REFERENCE TO RELATED APPLICATION

This application is related to the contemporaneously filed application for "Method and Apparatus for Electrolytic Recovery of Silver from Spent Photographic Processing Solutions", which application is hereby incorporated by reference.

BACKGROUND OF THE INVENTION

1. Field of the Invention

This invention relates to apparatus used in the recovery of silver from solutions such as spent photographic processing solutions. In particular, the invention relates to a cell configuration in silver recovery apparatus of the type comprising an anode-cathode cell for electrolytic recovery of silver, and more particularly to such apparatus of the type having a rotating cathode.

Recovery of silver is of course highly desireable from an economic viewpoint. Environmental factors are also extremely important, however. A high recovery efficiency is needed in order to meet or exceed the effluent standards established by agencies such as the Environmental Protection Agency in the United States.

Spent photographic processing solutions contain large quantities of silver. In such solutions, the dissolved silver is typically in a complex with either sodium or ammonium thiosulfate. There are also other sulfur compounds present, e.g. sodium sulfite and sodium bisulfite.

One particular commonly-used solution is a so-called "bleach-fix" solution, comprising a fixing agent which dissolves silver halides from the photographic film being processed, and a bleaching agent, which converts metallic silver into a silver halide. By the time the solution is spent and exits the photographic processing equipment, the bleaching agent is generally inactive, but it can be easily regenerated by oxidation.

Many forms of equipment exist for recovering this valuable silver from the solutions. It is well known that silver can be recovered from spent photographic solutions by using an electrolytic cell, i.e. by passing a direct current between electrodes immersed in the solution. The ionic silver, having a low reduction potential, is readily reduced to metallic silver at the cathode. The direct current applied to the electrodes causes the silver in the spent solution to deposit onto the cathode.

For maximum efficiency and speed in recovering the silver from bleach-fix solutions in particular, a high current density should be achieved at the cathode. However, reactions take place at the anode as well, and these reactions must be taken into account. These reactions can significantly affect the silver recovery process if the applied voltage becomes too high, in which case gases are evolved at both electrodes, and elemental sulfur is produced at the anode. This sulfur causes a problem with the silver recovery because it readily combines with the silver to form silver sulfide, which is insoluable. The silver sulfide forms a colloidial suspension, making it very difficult to reclaim the silver. This problem is commonly referred to as "sulfiding".

Another important factor in the overall efficiency of a recovery cell, as well as in reducing the tendency for sulfiding, is the conductance of the cell. The solution has a specific conductivity which does not change substantially until low silver concentrations are reached, unless salts are added. It is desireable to have a high conductance, so that a large current can be passed through the solution without applying a large voltage. The high current is desireable for achieving good recovery rates, and the low voltage is desireable to minimize other reactions.

As a natural result of recovering the silver, and to a lesser extent as a result of the other reactions, the conductivity of the solution decreases as the silver concentration reaches low levels. This causes the voltage to rise and current to drop, when using an unregulated power supply, resulting in decreased efficiency and increased sulfiding. It is not desireable to use a voltage regulated supply, however.

If stationary plate electrodes are used without agitation, then increased current density or decreased silver concentration results in very unsatisfactory current efficiency due to the depletion of silver within the boundary layer at the cathode surface, i.e. due to poor mass transfer. Furthermore, the low concentration of silver causes the voltage to rise thus resulting in excessive sulfiding. Current efficiency is defined such that at 100% current efficiency, one equivalent of silver, 108 grams, is deposited on the cathode for each faraday of current passed through the cell. This equates to 4.025 grams of silver per ampere-hour, or 7.72 ampere-hours per Troy ounce.

The probability of sulfiding when the silver concentration becomes low is further increased because of the problem of getting silver ions to the cathode surface, which is essentially a mass transfer problem. Mass transfer is an important factor in achieving high space-time yields. By mass transfer is meant the rate at which silver-laden solution can be transferred to the cathode. Space-time yield is a measure of the amount of silver recovered for a given apparatus or tank size over a given time.

It has been hypothesized that the rate of silver recovery is limited by the applied current at high concentrations of silver, and by the rate of diffusion of silver ions to the cathode at low silver concentrations. The rate is thus said to be current limited at high silver concentrations and transport limited at low silver concentrations. For any given apparatus and batch type, there is a well-defined silver concentration at which the transition from current-limited to transport-limited silver recovery rate occurs.

If stationary plates are used for electrodes in a tank of fixer, very low current densities must be used to prevent excessive sulfiding. This naturally results in very low current efficiency. To maintain efficient recovery of silver with nothing more than diffusion-limited mass transfer, i.e. mass transfer which is dependent on diffusion rather than forced circulation, a very large electrode surface area would be required to maintain low current densities.

By improving the mass transfer characteristics of the cell, recovery efficiency can be improved, because the silver can be reclaimed down to very low concentrations without excessive sulfiding. More efficient use of space and time can also be achieved if reduction in the size of the recovery cell can be achieved and if higher currents can be utilized.

The challenge for the equipment designer is essentially to achieve and sustain a high current efficiency and high space-time yield without excessive sulfiding.

2. Description of the Prior Art

In the prior art, few serious attempts have been made to develop new approaches to dealing with these problems.

One of the most widely utilized cell configurations is the "rotating cathode" design, the cathode usually consisting of stainless steel discs or a stainless steel drum rotating in the centre of a tank, a current source being connected to this cathode. Graphite plates carried on the inside perimeter of the tank directly adjacent to the cathode surfaces act as the anodes. This rotating cathode configuration allows the current density at the cathode surface to be increased dramatically compared to the current density in cells having stationary electrodes. This is primarily because of the smaller boundary layer at the cathode surface, which results in improved mass transfer. There is also an improvement in mass transfer because of the mixing of solution produced by the drag of the cathode rotating in the solution.

With minor changes in materials and dimensions, the simple rotating cathode configuration has remained the state of the art in silver recovery technology to date. Significant improvements generally have not been pursued vigorously, presumably because with a conventional rotating cathode and regular fixing solutions, current efficiencies on the order of 90 percent have been achieved. However, conventional rotating cathode configurations cannot achieve such high current efficiency in the case of the so-called "bleach-fix" solutions.

SUMMARY OF THE INVENTION

It is an object of the present invention to provide a novel rotating cathode cell configuration which results in improved current efficiency and space-time yield in the electrolytic recovery of silver from spent bleach-fix and regular photographic processing solutions.

Thus in accordance with the invention there is provided apparatus for the electrolytic recovery of silver from spent photographic processing solutions. The apparatus comprises a tank for containing spent photographic processing solution from which silver is to be recovered, at least one cylindrical cathode, each cathode being carried for rotation in the tank about a vertical axis, and for each cathode, at least one vertically disposed slat-like anode carried in alignment close to the cathode. Each anode is positioned with respect to a cathode surface so as to define a vertically elongated venturi between the cathode and the anode, the narrowest section of each venturi being substantially along a vertical edge of each anode. Means are provided for rotatably supporting the cathode in the tank, for supporting each anode in position with respect to the cathode, and for supplying power to each rotating cathode and each anode. A motor is connected to rotate the cathode.

In accordance with another feature of the invention, each anode is substantially parallel to a tangent drawn to the cathode surface opposite the vertical edge of the anode at the narrowest section of the venturi.

Further features of the invention will be described or will become apparent in connection with the following detailed description of the invention.

BRIEF DESCRIPTION OF THE DRAWINGS

In order that the invention may be more clearly understood, preferred embodiments of the invention will now be described in detail by way of example only, with reference being made to the accompanying drawings, in which.

DETAILED DESCRIPTION OF THE PREFERRED EMBODIMENTS

Figure 1:
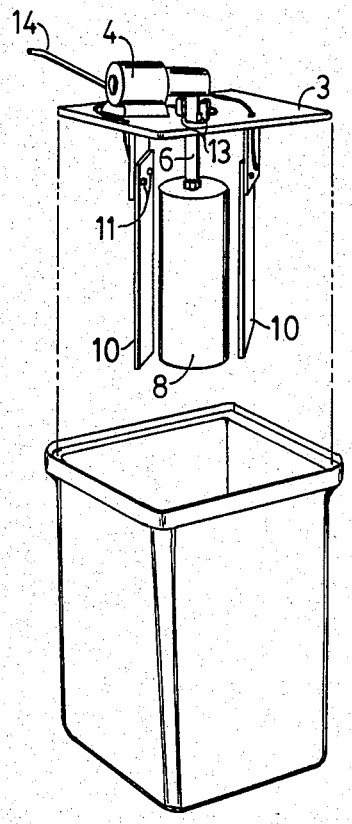
FIG. 1 is a perspective drawing of a simple version of the apparatus, exploded to show the platform and electrodes of the apparatus removed from the solution-containing tank.

Referring first to FIG. 1, there is illustrated a simple version of the preferred embodiment of the silver recovery apparatus of the present invention, suitable for small batches of solution such as 10 U.S. gallons or 36 liters.

A tank 1 contains the solution, such as bleach-fix solution, which is to be desilvered. The tank has a recessed platform support flange 2 which accommodates a platform 3, the platform preferably being transparent.

Mounted on the platform 3 is an electric motor 4 having a driveshaft 6 projecting vertically downwardly through the center of the platform. A cylindrical cathode 8 is installed on the driveshaft for rotation in the solution. Also mounted on the platform, on opposite sides of the cathode and substantially equidistant therefrom, are two downwardly projecting anode supports, each of which has a vertically disposed slat-like anode 10 attached to it by two bolts and nuts 11. The cathode and anodes preferably extend down to reasonably close to the bottom of the tank, for optimum effectiveness.

The anodes 10 and cathode 8 are electrically connected to a direct current power supply (not illustrated) such as that described in the above-mentioned copending application, via a cable 14. The cable 14 has four wires, two being used to also supply power to the electric motor 4. The negative terminal of the power supply is grounded. The cathode 8 is connected to the power supply through the driveshaft 6, spring-loaded brushes 13 engaging the driveshaft, and thence via the cable 14.

Figure 2:
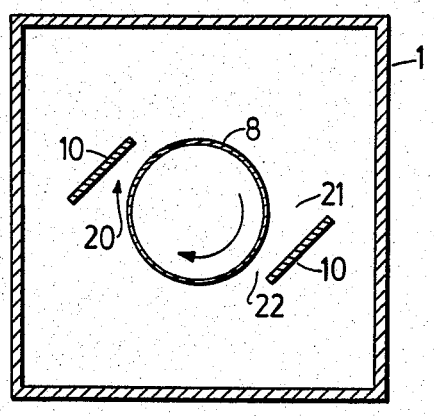
FIG. 2 is top view of the apparatus, showing the anodes, the cathode, and the tank walls in section.

As can be seen most clearly from FIG. 2, the anodes 10 are positioned with respect to the surface of the rotating cathode 8 so as to create venturis 20 between the cylindrical cathode surface and the flat anode surfaces. The direction of rotation of the cathode is such that the solution is drawn into the wide ends 21 of the venturis by virtue of the drag of the cathode in the solution. As the solution is drawn into the wide end 21 of each venturi, it must accelerate to exit from the narrow end 22. This has several effects. First of all, it has the same effect as increasing the speed of rotation of the cathode by a substantial amount, without the obvious mechanical difficulties of doing so (e.g. splashing, and the need for a larger motor). Secondly, it creates turbulent flow which has important advantages as described below.

The angle of the anodes 10 with respect to the cathode 8 when viewed from above is selected keeping in mind two main considerations, namely the desire for a good venturi effect, and the desire for excellent mass transfer between the anode and cathode. It will be obvious to those skilled in the art that there is a range of angles which may be suitable to varying degrees, the exact optimum angle varying from installation to installation and being a matter of empirical determination through routine experimentation. In the preferred embodiment, the angle is such that the anodes 10 are roughly parallel to tangents drawn to the surface of the cathode 8 at the vertical edges of the anodes at the narrowest sections of the venturis, and preferably the angle should not be less than that or otherwise the narrowest sections of the venturis 20 would not be at the vertical edges of the anodes.

This configuration produces a very high field strength because of the small distance between the cathode and the anodes at the narrow ends 22 of the venturis, and in addition because of the vertical edges of the anodes, with their 90 degree corners, being presented towards the cathode. This high field strength increases the velocity of the silver ions towards the cathode. If desired, the vertical edges of the anodes at the narrow ends of the venturis may be made sharper than a ninety-degree corner to further concentrate the field.

In the preferred embodiment, the anodes 10 are of graphite and the cathode 8 is of stainless steel, although other suitable materials, well known to those skilled in the art, could be used.

The ratios between sizes of components and between distances between electrodes are more important than actual sizes and distances. It is important that the tank 1 not be disproportionately large with respect to the electrode assembly. If the tank 1 is too large compared to the electrodes, mass transfer suffers, with a resulting loss of efficiency. The walls of the tank 1 play a role in preventing solution from escaping too far from the area of the tank which is under the influence of the mixing action produced by the rotating cathode and by the anode and cathode configuration. As a general rule, it is desireable to have the cross-sectional area of the cathodes occupy at least about 10% of the cross-sectional area of the tank, and preferably more.

It should be obvious to those skilled in the art that the actual dimensions may be varied considerably, but in this 10 gallon embodiment the dimensions are approximately as follows: tank dimensions: 12 inches by 12 inches by 18 inches deep; cathode dimensions: 5 inches diameter by 10 inches long; anode dimensions: 3 inches by 5/16th inches by 12 inches long; distance between cathode surface and anodes at narrow ends 22 of the venturis: ¾ of an inch.

In recovering silver, the tank is filled with the spent photographic solution from which the silver is to be recovered, and the platform 3 is lowered onto the platform support flange 2 to position the cathode and anodes in the solution. The motor is engaged to rotate the cathode, typically at about 170 revolutions per minute, and direct current is supplied to the electrodes via the power supply.

Power is supplied such that a maximum voltage of about 4 volts is not exceeded. In an embodiment of this 10 gallon size, this translates into about 25 amperes of current for bleach-fix solutions. For regular fixer, a maximum of about 5 or 6 amps is desired to avoid sulfiding, so the voltage is usually about 1.2 or 1.3 volts. The low voltage and high current means that very low resistance must be maintained. The brushes 13 and the electrical connections to the anodes must therefore be kept clean, as in any rotating cathode apparatus, which is facilitated and encouraged in this case by the open design in which the connections are both accessible and visible.

The geometry of this cell results in a number of highly desireable features, as a result of factors which have been largely overlooked in conventional silver recovery cells. One advantage is greatly increased turbulence at the surface of the cathode 8, which decreases the thickness of the boundary layer and thus improves local mass transfer, as will be discussed. Another advantage is improved mass transfer throughout the cell, and another is increased conductance of the cell due to increased electric field strength.

High field strength and good mass transfer through the region of the field are factors in achieving high current efficiency. Good mass transfer also avoids sulfiding as the voltage increases for a given current level, which it tends to do as the silver concentration is reduced.

The result of the rotating cathode and the orientation of the anodes 10 with respect to the cathode 8 is that there is excellent mass transfer throughout the cell, and in particular between the anodes and the cathode. This excellent mass transfer helps greatly in preventing excessive sulfiding. Furthermore, the fluid flow in the region of the cathode surface is relatively turbulent due to the constrictions produced by venturis 20, and this turbulence minimizes the size of the boundary or diffusion layer adjacent to the cathode surface. If a stable boundary layer is permitted to become established, the silver concentration in that boundary layer drops rapidly, and sulfiding occurs. With the cell geometry of the present invention, not only is there good mass transfer throughout the cell, but also that mass transfer is effective virtually down to the surface of the cathode due to the absence of a stable boundary layer. Silver recovery is thus not as dependent on the diffusion of silver ions through a boundary layer.

The proximity of the vertical edges of the anodes 10 to the cathode 8, and their orientation with respect to the cathode, produces a high field strength near the anode edges closest to the cathode, i.e. in the narrow ends 22 of the venturis, especially near the anode corners closest to the cathodes. It is this high field strength and the mass transfer silver-bearing solution into the region of the cathode which ultimately determines the silver recovery rate.

Because of the effective mass transfer in this cell geometry, the field strength and hence the current can be kept high throughout the recovery process without excessive sulfiding taking place as the voltage increases. Thus a high current density can be maintained, it not being necessary to reduce the current level in response to decreasing silver concentration, as is common in the prior art. With the geometry of the present invention, it has been possible to achieve unusually high current densities without excessive sulfiding.

Yet another advantage of the present invention when bleach-fix solutions are being desilvered is that because of the high conductance of the cell, relatively little anode surface area is required, compared to the surface area of the cathode. This results in a disparity between the oxidation and reduction rates of the bleaching agent, usually ferric EDTA, there being a tendency to produce more ferrous EDTA than ferric EDTA, ferric EDTA being the active state. With relatively little anode surface area, the bleach is thus not regenerated to the extent that it otherwise would be, and thus not as much bleach is present to act to tend to redissolve recovered silver.

Figure 3:
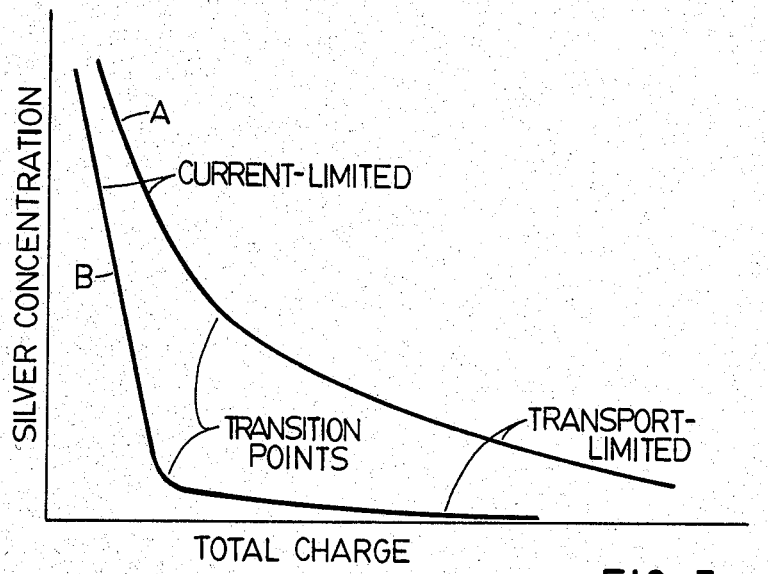
FIG. 3 is a graph of silver concentration versus total charge passed in ampere-hours.

The effect of the geometry of this cell may be viewed in terms of mass transfer, by examining a graph of silver concentration versus total charge in ampere-hours, such as that in FIG. 3. As discussed above, the rate of silver recovery is current limited at high silver concentrations and transport limited at low silver concentrations. For any given apparatus and batch type, there is a well-defined silver concentration at which the transition from current-limited to transport-limited silver recovery rate occurs. The curves in FIG. 3 relate to silver recovery from bleach-fix solutions, curve A indicating a typical prior art situation. Curve B indicates the effect of the improved mass transfer in the cell geometry of the present invention in lowering the transition concentration, so that a greater percentage of silver is recovered while current limited rather than transport limited, resulting in greater overall current efficiency. Furthermore, with this cell geometry the current efficiency even in the current-limited phase of recovery is improved, as indicated by the steep slope of the curve during current-limited recovery. Sulfiding occurs mainly after the transition point is reached, i.e. during transport-limited recovery, and with the arrangement of the present invention the transition concentration is low. The solution may therefore be desilvered to a lower level without undue inefficiency, e.g. down to a level of 10 to 20 milligrams per liter of solution, and both size and power requirements may be reduced for given silver recovery levels due to the increased current efficiency. Also, silver of higher purity may be recovered due to the decreased sulfiding, since sulfiding also tends to substantially increase the level of impurities in the recovered silver. Yet another advantage is that there is no need to add sulfite as in some cells having poor mass transfer, in which sulfite is commonly added to suppress thiosulfate destruction, since thiosulfate destruction causes some sulfiding.

Figure 4:
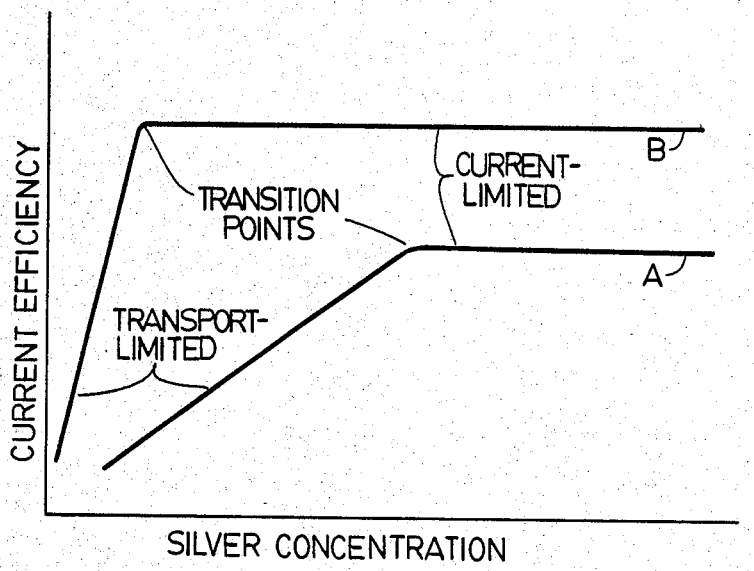
FIG. 4 is a graph of current efficiency versus silver concentration.

This effect can also be seen by looking at a graph of current efficiency versus silver concentration, FIG. 4, again relating to bleach-fix solution. Curve A in FIG. 4 indicates a typical prior art situation. Curve B illustrates the improved current efficiency and lower transition concentration resulting from the geometry of the cell of the present invention.

The result of being able to maintain the high field strength and current density is sustained high current efficiency. High current utilization rates are thus achieved. In the case of regular solutions, the increased efficiency is not so evident or dramatic, given that in the prior art it was possible to achieve fairly high efficiencies, but still a significant increase in efficiency is noted. This is because the geometry of this cell results in a lower transition concentration, i.e. the silver recovery rate is current-limited down to lower concentrations. Sulfiding occurs mainly in transport-limited recovery.

Figure 5:
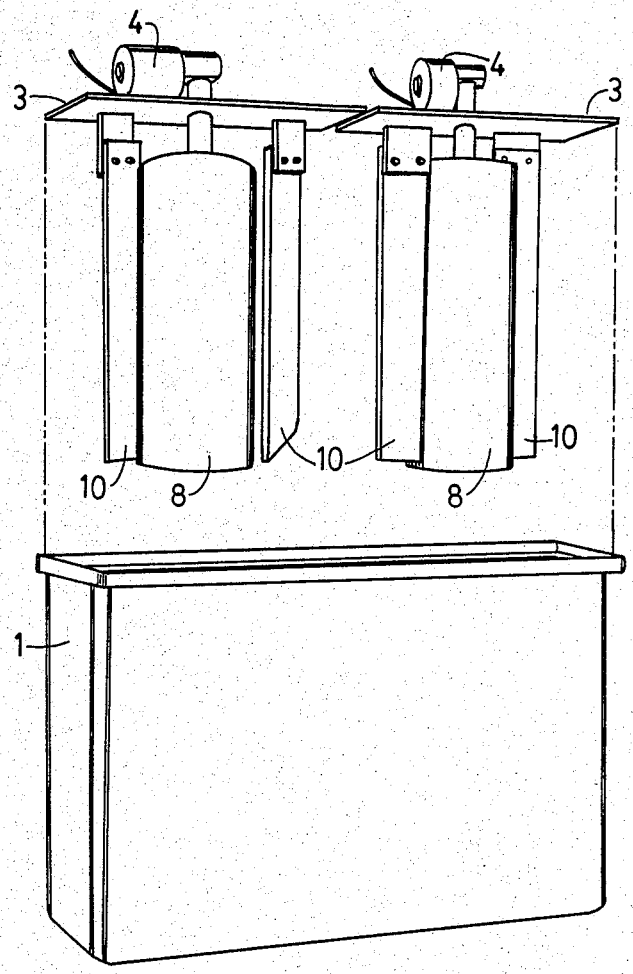
FIG. 5 is a perspective of a larger two-cathode version of the apparatus.
Figure 6:
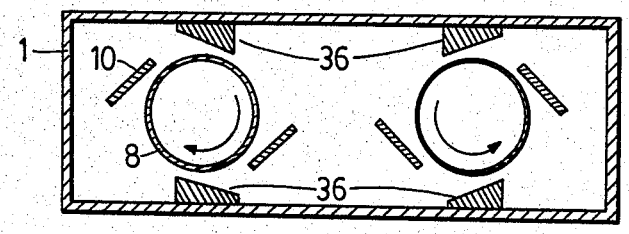
FIG. 6 is a top view of the larger version of the apparatus, showing the anodes, cathodes and tank walls in section.

Referring now to FIGS. 5 and 6, there is illustrated an embodiment of the invention suitable for processing larger batches of solution. This embodiment has a 130 liter tank 1, and two platforms 3, each platform carrying a motor 4, two platform-mounted downwardly-projecting anodes 10, and a rotating cathode 8, substantially as in the simpler embodiment described above.

Mounted on the walls of the tank 1 are two tank-mounted anodes 36 for each cathode, such that when each platform 3 is lowered to the tank, each cathode is presented with four anodes, two being mounted on the tank, and two being suspended from the platform. The anodes are wedge-shaped in order to achieve the desired orientation of the anode surface with respect to the cathode.

The tank-mounted anodes 36 are not essential, i.e. it is not essential to have a total of four anodes per cathode in this embodiment. Nor is it necessary to have two or only two anodes in the simple embodiment first described above. It should be apparent that the system could be constructed with only one anode per cathode if desired, or with more than four anodes, although it might not be optimally efficient to do so. The desired cell conductance is what primarily governs the choice of the number of electrodes, and the desired cell conductance of course depends on the solutions intended to be processed. Four anodes has been found to be convenient and effective for the larger embodiment, and two for the smaller embodiment, for a typical bleach-fix solution mixed 4:1 with wash water. The wash water decreases the conductivity of the solution, so anodes are added, bringing the total to four per cathode, to increase the cell conductance. The cell conductance is the ratio between the current supplied to the cell and the applied voltage.

In this embodiment, in addition to the electrical connections on the platforms 3, there are also connections for connecting the tank-mounted anodes 36 to the power supply. Separate power supplies supply the platforms.

In this larger version, it is convenient to use a pump to transfer solution from a larger reservoir (not shown) to the tank 1 for desilvering, with the solution circulating back and forth from the reservoir to the tank until all of the solution is adequately desilvered. This reservoir permits larger quantities than can be contained in the tank 1 to be desilvered conveniently.

It can be seen from the drawings that in this larger version, the same dimensional proportions are substantially maintained. Key dimensions are as follows, for example: cathode dimensions: 7½ inches diameter by 15 inches long; anode dimensions: 4 inches ⅜ inches by 17 inches long; distance between cathode surface and anodes at narrow ends 22 of the venturis: 1 inch; tank dimensions: 12 inches by 36 inches by 24 inches deep.

It will be appreciated that the above description relates to preferred embodiments of the invention only, and that many variations are possible which would be obvious to those skilled in the art. Such variations are considered to be within the scope of the invention.

What is claimed as the invention is:

1. Apparatus for the electrolytic recovery of silver from spent photographic processing solutions, comprising:

a tank for containing spent photographic processing solution from which silver is to be recovered;

at least one cylindrical cathode, each said cathode carried for rotation in said tank about a vertical axis;

for each said cathode, at least one vertically disposed slat-like anode carried in alignment close to said cathode, each said anode being positioned with respect to the surface of said cathode so as to define a vertically elongated venturi between said cathode and said anode, the narrowest section of each said venturi being substantially along a vertical edge of each said anode;

means for rotatably supporting said cathode in said tank;

means for supporting each said anode in said position with respect to said cathode;

a motor connected to rotate said cathode at a rate sufficient to induce turbulence in the solution in the region of each said venturi; and means for supplying power to each said rotating cathode and each said anode.

2. Apparatus as recited in claim 1, in which each said anode is substantially parallel to a tangent drawn to the cathode surface opposite said vertical edge of said anode at the narrowest section of said venturi.

3. Apparatus as recited in claim 1, in which the narrowest section of each said venturi is not substantially more than about one inch in horizontal dimension.

4. Apparatus as recited in claim 1, in which each said anode is substantially parallel to a tangent drawn to the cathode surface opposite said vertical edge of said anode at the narrowest section of said venturi, and in which the narrowest section of each said venturi is not substantially more than about one inch in horizontal dimension.

5. Apparatus as recited in claim 1, in which the cross-sectional area of said cathode or cathodes is at least ten percent of the cross-sectional area of said tank, for good mass transfer of solution in said apparatus.

6. Apparatus as recited in claim 2, in which the cross-sectional area of said cathode or cathodes is at least ten percent of the cross-sectional area of said tank, for good mass transfer of solution in said apparatus.

7. Apparatus as recited in claim 3, in which the cross-sectional area of said cathode or cathodes is at least ten percent of the cross-sectional area of said tank, for good mass transfer of solution in said apparatus.

8. Apparatus as recited in claim 4, in which the cross-sectional area of said cathode or cathodes is at least ten percent of the cross-sectional area of said tank, for good mass transfer of solution in said apparatus.

9. Apparatus as recited in claim 1, in which the vertical edge of each said anode at the narrowest section of said venturi has a ninety-degree or sharper corner, whereby the strength of the electric field is concentrated in the region of the venturi.

10. Apparatus as recited in claim 2, in which the vertical edge of each said anode at the narrowest section of said venturi has a ninety-degree or sharper corner, whereby the strength of the electric field is concentrated in the region of the venturi.

11. Apparatus as recited in claim 3, in which the vertical edge of each said anode at the narrowest section of said venturi has a ninety-degree or sharper corner, whereby the strength of the electric field is concentrated in the region of the venturi.

12. Apparatus as recited in claim 4, in which the vertical edge of each said anode at the narrowest section of said venturi has a ninety-degree or sharper corner, whereby the strength of the electric field is concentrated in the region of the venturi.

13. Apparatus as recited in claim 5, in which the vertical edge of each said anode at the narrowest section of said venturi has a ninety-degree or sharper corner, whereby the strength of the electric field is concentrated in the region of the venturi.

14. Apparatus as recited in claim 6, in which the vertical edge of each said anode at the narrowest section of said venturi has a ninety-degree or sharper corner, whereby the strength of the electric field is concentrated in the region of the venturi.

15. Apparatus as recited in claim 7, in which the vertical edge of each said anode at the narrowest section of said venturi has a ninety-degree or sharper corner, whereby the strength of the electric field is concentrated in the region of the venturi.

16. Apparatus as recited in claim 8, in which the vertical edge of each said anode at the narrowest section of said venturi has a ninety-degree or sharper corner, whereby the strength of the electric field is concentrated in the region of the venturi.

* * * * *